US005931657A

United States Patent [19]

Klouda et al.

[11] Patent Number: 5,931,657

[45] Date of Patent: Aug. 3, 1999

[54] GAS BURNER

[76] Inventors: Jaroslav Klouda, Dallmayrstrasse 15, 82256 Fuerstenfeldbruck, Germany; Maarten Joannes Botman, Prinsentraat 15, NL 3581 JR Utrecht, Netherlands

[21] Appl. No.: 09/030,376

[22] Filed: Feb. 25, 1998

[30] Foreign Application Priority Data

Feb. 28, 1997 [DE] Germany ..... 197 08 218

[51] Int. Cl.[6] ..... F23D 14/70; F23D 14/62

[52] U.S. Cl. ..... 431/181; 431/185; 431/187; 431/353

[58] Field of Search ..... 431/5, 8, 9, 10, 431/181, 187, 185, 188, 353, 159

[56] References Cited

U.S. PATENT DOCUMENTS

| | | |
|---|---|---|
| 2,244,821 | 6/1941 | Bloom . |
| 2,615,407 | 10/1952 | Ragusen . |
| 3,915,625 | 10/1975 | Hapgood . |
| 3,957,421 | 5/1976 | Wikman . |

FOREIGN PATENT DOCUMENTS

| | | |
|---|---|---|
| 23 19 194 | 10/1974 | Germany . |
| 1 345 442 | 1/1974 | United Kingdom . |

*Primary Examiner*—Carl D. Price
*Attorney, Agent, or Firm*—Hill & Simpson

[57] ABSTRACT

A gas burner has an air delivery channel connected to a combustion chamber by a deflection element for deflecting the gas stream from the air delivery channel into the combustion chamber. The gas burner has an arrangement that will reduce the gas stream on the outside of the combustion chamber that is at a greater distance from the air delivery channel with reference to the flow direction in the air delivery channel in a section along a plane of the angle between the direction of the gas stream in the combustion chamber and the direction of the gas stream in the air delivery channel in favor of the gas stream on the inside of the combustion chamber that lies closer to the air delivery channel along the plane so that the gas stream in the combustion chamber is made more uniform with reference to the cross-section extending perpendicular to the direction of the gas stream in the combustion chamber.

10 Claims, 3 Drawing Sheets

GAS BURNER

BACKGROUND OF THE INVENTION

The present invention is directed to a gas burner, particularly for employment in kitchen technology. The gas-burner comprises an air delivery channel and a combustion chamber that are arranged at an angle relative to one another and has a deflecting means for deflecting a gas stream from the air delivery channel into the combustion chamber. Because of the advantage provided by this compact structure, the gas burner can be utilized, among other things, for example, in conjunction with a steam generator for an equipment which is used for large-scale catering of food products.

A mixture of air and combustion gas, that is subsequently introduced into a combustion chamber, is usually generated in the region of a deflecting means. The deflection of the gas stream, which can be composed of either air or a mixture of air and combustion gases, coming from the direction of an air delivery channel into the direction of the combustion chamber causes the flow rate of the air/combustion gas mixture that enters into the combustion chamber to be greater on the outside of the combustion chamber, for instance the side that is at the greatest distance from the air delivery channel with reference to the flow direction in the air delivery channel, then on the opposite side, which is closest to the air delivery channel. This will lead to a non-uniform combustion with reference to the cross-section of the combustion chamber in a direction perpendicular to the direction of the flow of gas in the chamber.

SUMMARY OF THE INVENTION

An object of the present invention is to create a gas burner which allows a uniform combustion in the combustion chamber with reference to the cross-section extending perpendicular to the direction of flow in the combustion chamber.

This object is inventively achieved in a gas burner, which has an air delivery channel and a combustion chamber that are arranged at an angle relative to one another and has a deflection means for deflecting the gas stream from the air delivery channel into the combustion chamber, by providing compensation means that will reduce the gas stream at or close to the outside of the combustion chamber that is at a greater distance from the air delivery channel in a section along the plane of the angle between the direction of the gas flow in the combustion chamber and the direction of the gas stream in the air delivery channel in favor of the gas stream at or close to the inside of the combustion chamber that lies closer to the air delivery channel in a section along the plane of the angle between the direction of the gas stream in the combustion chamber and the direction of the gas stream in the air delivery channel so that the gas stream in the combustion chamber is made more uniform with reference to a crosssection extending perpendicular to the direction of the gas stream in the combustion chamber.

The invention can provide a deflector that will divide the gas stream in a part of the deflection means that forms an extension of the air delivery channel into a plurality of substreams, wherein the first, smaller sub-stream is conducted to the outside of the combustion chamber and a second, greater sub-stream is conducted to the inside of the combustion chamber.

It is also inventively provided that the deflection means comprises means for generating a rotational turbulence of a gas stream coming from the air delivery channel after the deflection in the direction of the combustion chamber so that the axis of rotation generated in this way is essentially parallel to the direction of the flow of the gas stream in the combustion chamber.

A baffle plate can also be provided, and this baffle plate lends at least a part of the gas stream a momentum or momentum component parallel to and/or opposite the direction of the gas stream in the delivery channel in the deflection means following the deflection of the gas stream coming from the air delivery channel.

A deflector element for deflecting the gas stream coming from the air delivery channel in the deflection means can also be provided, and this will have one end projecting partly into the gas stream transversely to the direction of the gas stream and comprises guide surfaces, which are parallel to the direction of the gas stream in the combustion chamber and are arranged to form a cross-section in the shape of a cross.

The guide surfaces of the deflector element can be angled off at the end pointing toward the combustion chamber, whereby an angled-off sections point in the same direction with reference to a rotation around the longitudinal axis of the deflector element.

It can also be inventively provided that an at least partially helical air guide plates are arranged in the deflection means, whereby the helical axis is parallel to the direction of the gas stream in the combustion chamber.

The inventive gas burner can comprise a pre-mixing chamber and a secondary air channel or chamber. These two chambers are arranged between the air delivery channel and the combustion chamber, whereby means for making the gas stream in the combustion chamber more uniform with respect to a cross-section extending perpendicular to the direction of the gas stream in the combustion chamber are provided in the pre-mixing chamber and/or in the secondary air channel.

It can thereby be provided that the means for producing a twist in the gas stream with a rotational axis parallel to the direction of the gas flow or stream in the combustion chamber is provided in the pre-mixing chamber and in the secondary air channel, whereby the twist lent the gas stream in the pre-mixing chamber is opposite the twist that is lent to the gas stream in the secondary air channel.

Deflection means can also be provided in the secondary air channel. This deflection means steers a greater part of the secondary air to the region of the discharge of the pre-mixing chamber into the combustion chamber and a smaller part of the secondary air to the outside or, respectively, to the inside of the combustion chamber.

The pre-mixing chamber can be angularly fashioned with a portion extending parallel to the axis of the combustion chamber, and the means for rendering the gas stream in the combustion chamber more uniform can be arranged in this portion that extends essentially parallel to the flow direction in the combustion chamber.

Other advantages and features of the invention will be readily apparent from the following description of the preferred embodiments, the drawings and claims.

DESCRIPTION OF THE PREFERRED EMBODIMENTS

Figure 1A:
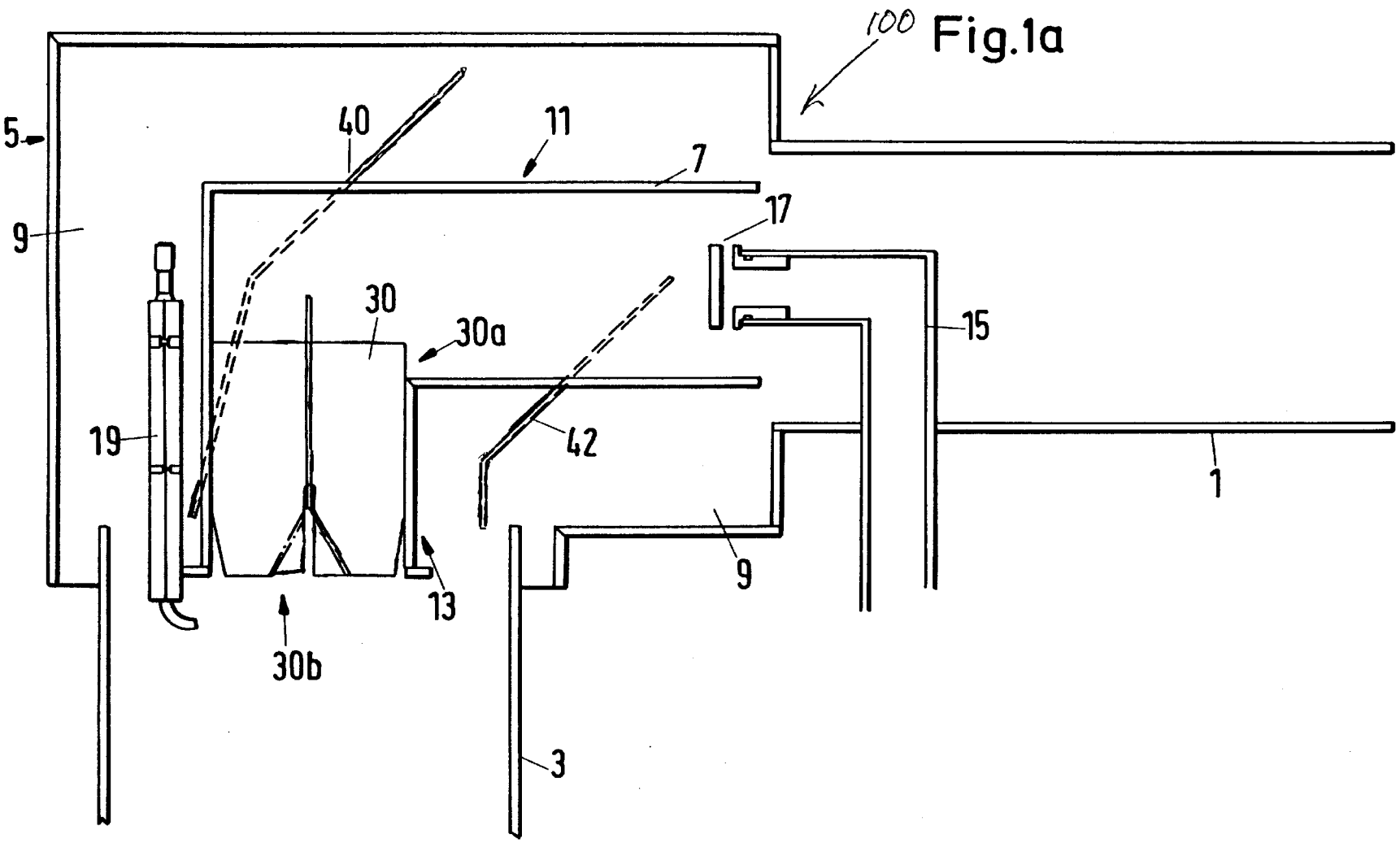
FIG. 1*a* is a schematic cross-sectional view of the gas burner of the present invention.
Figure 1B:
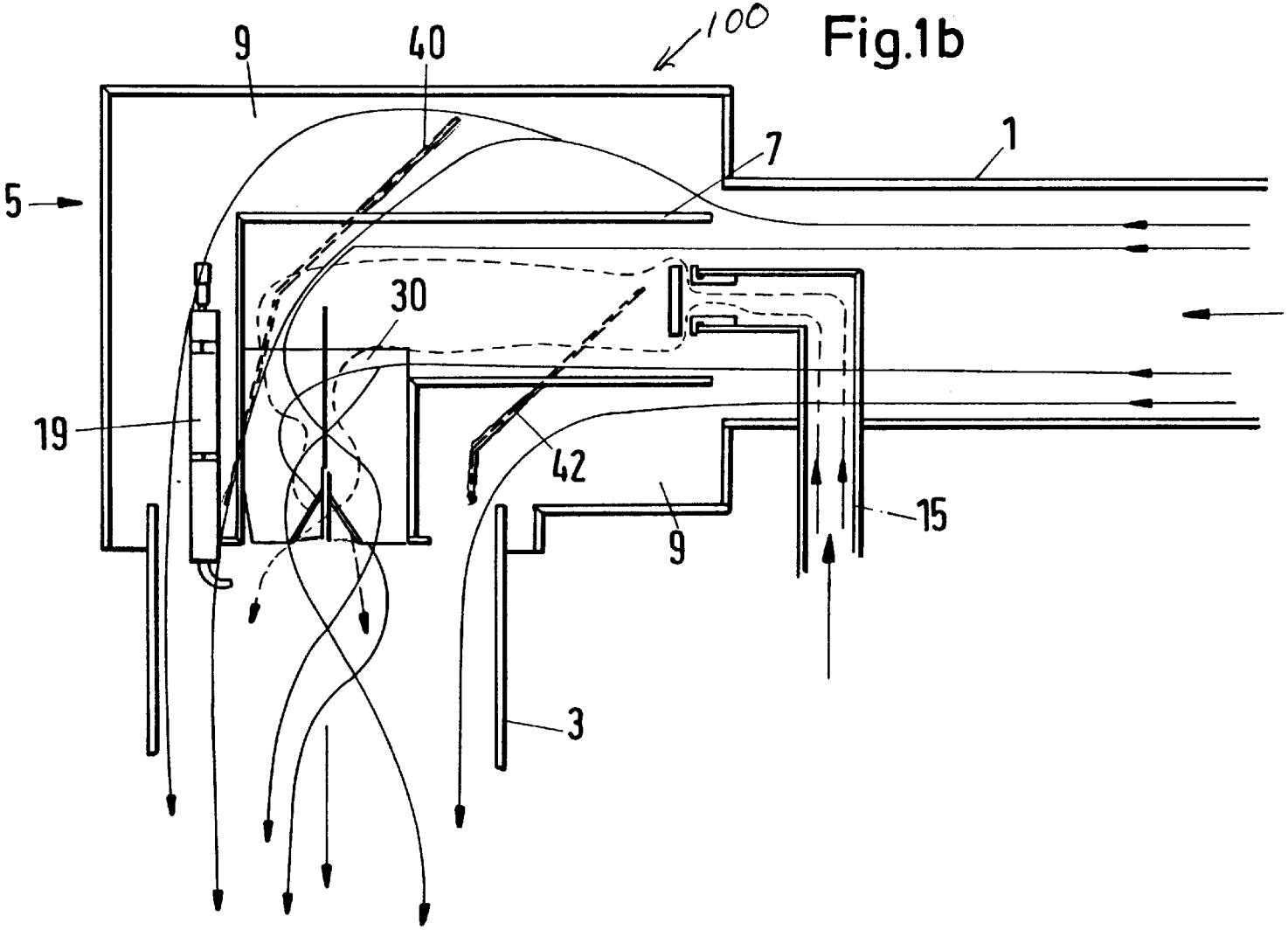
FIG. 1*b* is a schematic cross-sectional view of FIG. 1*a* with arrows indicating the flow direction.

The principles of the present invention are particularly useful when incorporated in a gas burner, generally indicated at 100 in FIGS. 1*a* and 1*b*. The burner 100 comprises an air delivery channel 1 and a tubular combustion chamber 3 that are connected by a deflection or deflecting means 5. The deflection means 5 contains a pre-mixing pipe 7 and a secondary air channel 9 that surrounds the pre-mixing pipe 7 so that the pre-mixing pipe 7 and the secondary air channel 9 are essentially concentric relative to one another. The pre-mixing tube or pipe 7 is essentially an elbow member or a tube bent in a right angle with one leg 11 proceeding parallel to the air delivery channel 1 with the entrance end of the pre-mixing tube 7 coacting with the wall of the air delivery channel to form an admission opening for the secondary air channel 9. The other leg 13 of the pre-mixing pipe or tube extends parallel to the direction of the gas stream in the combustion chamber and, thus, is parallel to the longitudinal direction of the combustion chamber 3. As illustrated, the leg 11 extends at right angles to the leg 13.

A conduit 15 introduces combustion gases through a combustion gas nozzle 17 into the air stream in the pre-mixing tube 7, where the gases are mixed and conducted in the pre-mixing tube 7. An ignition electrode 19 for igniting the emerging rich air/combustion gas mixture is provided at the exit end of the pre-mixing tube 7 and the entrance into the combustion chamber 3. In addition to the immediate burning of the fuel mixture, a secondary burning occurs with the secondary air supplied via the secondary air channel 9.

Figure 2B:
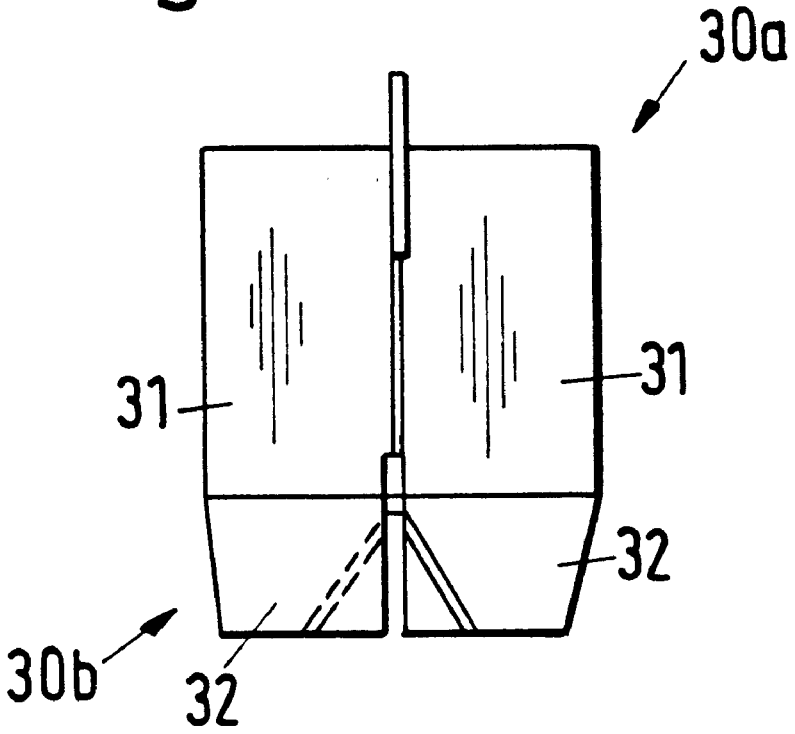
FIG. 2*b* is a side view of the deflector element shown in FIG. 2*a*.
Figure 2A:
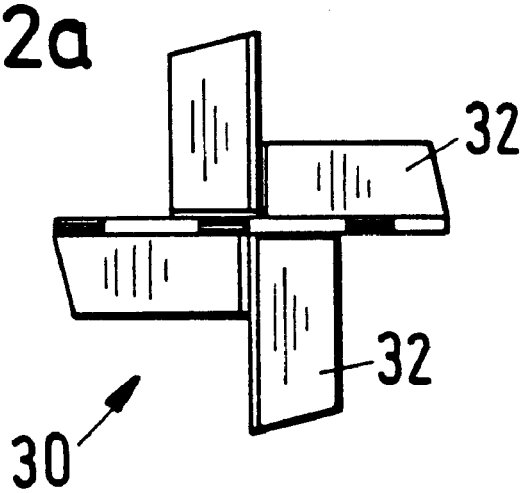
FIG. 2*a* is a top end view of a deflector element removed from the gas burner of the present invention.

For rendering the gas stream emerging from the pre-mixing tube or pipe 7 more uniform, a deflection element 30, that projects into the leg 11 that extends parallel to the air delivery channel 1, is introduced and mounted in the leg 13. In an upper region 30*a* (best shown in FIG. 2*b*), the deflection element 30 comprises four planar surfaces 31, which are arranged parallel to the direction of the leg 13, and forms a cross-section of a cross. The outer edges of these crossed members lie against the wall of the leg 13 of the pre-mixing tube. In a lower region 30*b*, the cross-shaped cross-section merges into angled-off planar paddle sections 32. These paddle sections form an obtuse angle with the corresponding surface of the section 30*a* and are arranged dynamically balanced in the fashion of a propeller, so that they respectively direct the gas stream impacting them into a rotational pulse or twist in the same direction. The paddle sections 32 need not be planar, but can also be curved, for instance in the fashion of a turbine blade or paddle.

The deflection element 30 has a double function. As a result of the cross-shaped part in the region 30*a* that projects into the region of the entrance leg 11 of the pre-mixing tube 7, the part of the gas flow in the pre-mixing tube 7 that is conducted to the outside of the combustion chamber is limited. This part is all the smaller the farther the element 30 projects into the leg 11. The non-equilibrium that would otherwise exist between the flow at the outside and the flow at the inside of the combustion chamber 3 is thus compensated. The paddle-shaped sections 32 lend the gas stream respectively impacting thereon a rotational pulse in the same direction, so that an eddy having a rotational axis essentially parallel to the flow direction in the combustion chamber 3, i.e., parallel to the longitudinal axis thereof, will occur. A farther-reaching homogenization of the gas stream emerging from the pre-mixing tube 7 thus occurs, and this ultimately creates a largely uniform emergence of the air/combustion gas mixture and, thus, a uniform combustion occurs with reference to the cross-section extending perpendicular to the flow direction in the combustion chamber 3.

Air guide surfaces 40 and 42, which are shown in FIGS. 1*a* and 1*b*, are arranged in the secondary air channel 9. These air guide surfaces 40 and 42 have the job of concentrating the main part of the air flow in the secondary air channel from the entrance of the pre-mixing tube 7 into the combustion chamber 3, so that the secondary air combustion is optimized. By contrast thereto, the flow of the air in the secondary air channel 9 toward the wall of the combustion chamber is minimized.

In an embodiment of the invention that is not shown, additional means for generating a twist of the gas flow with a rotational axis parallel to the flow direction in the combustion chamber 3 is provided in the secondary air channel. The twist generated in this way, however, is opposite to the twist that is generated by the paddle-shaped sections 32 of the deflector elements 30. As a result thereof, an especially good blending of the secondary air with the emerging gas mixture occurs.

Although various minor modifications may be suggested by those versed in the art, it should be understood that we wish to embody within the scope of the patent granted hereon all such modifications as reasonably and properly come within the scope of ourcontribution to the art.

We claim:

1. A gas burner comprising a combustion chamber having an axis and a cross-section extending transverse to the axis; an air delivery channel extending at an angle to the axis of the combustion chamber; deflecting means between the air delivery channel and the combustion chamber to deflect an air stream from the air delivery channel into the combustion chamber; compensation means for equalizing the air flow across the cross-section of the combustion chamber being disposed in the deflecting means, said compensation means including a mixing tube having a first section extending on an axis of the delivery channel being connected to a second section extending on the axis of the combustion chamber, said mixing tube creating a primary air flow and a secondary air flow and a combustion gas conduit discharging a flow of combustion gas into the first section so that the flow of combustion gas is mixed with the primary air flow and then discharged from the second section into the combustion chamber with the secondary air flow.

2. A gas burner according to claim 1, wherein the compensation means includes means for generating a rotational turbulence of an air flow coming from the air delivery channel after the deflection in the direction of the flow into the combustion chamber so that the axis of rotation of the rotational turbulence is essentially parallel to the direction of the gas stream in the combustion chamber.

3. A gas burner according to claim 1, wherein the angle between the axis of the combustion chamber and the axis of the delivery channel is a right angle.

4. A gas burner according to claim 1, wherein the compensation means includes a deflector element for deflecting an air flow in the first section, said element being disposed in said second section and extending partially into the first section and comprising crossing guide surfaces which extend parallel to the direction of the gas stream in said second section.

5. A gas burner according to claim 4, wherein the guide surfaces of the deflector element are arranged in the form of a cross and are angled-off at an end pointing toward the combustion chamber, whereby the angled-off sections point in the same direction with reference to a rotation around the longitudinal axis of the deflector element.

6. A gas burner according to claim 4, which includes guide plates being arranged in the deflector means outside of the mixing tube, said guide plates extending in a helical path parallel to the axis of the combustion chamber to create a rotational turbulence in the secondary air flow.

7. A gas burner according to claim 6, wherein the deflector elements are arranged in the form of a cross and are angled-off at an end pointing toward the combustion chamber with the angled-off sections pointing in the same direction with reference to the rotation around the longitudinal axis of the deflector element to create a twist in the primary air flow opposite the twist in the secondary air flow as the air flows are introduced into the combustion chamber.

8. A gas burner comprising a combustion chamber having an axis and a cross-section extending transverse to the axis; an air delivery channel extending at an angle to the axis of the combustion chamber; deflecting means between the air delivery channel and the combustion chamber to deflect an air stream from the air delivery channel into the combustion chamber; compensation means for equalizing the air flow across the cross-section of the combustion chamber being disposed in the deflecting means and a combustion gas conduit discharging a flow of combustion gas into the deflecting means, said deflecting means including means for generating a rotational turbulence of a gas stream coming from the air delivery channel after the deflection in the direction of the flow in the combustion chamber so that the axis of rotation of the rotational turbulence is essentially parallel to the direction of the gas stream in the combustion chamber.

9. A gas burner according to claim 8, wherein the means for generating includes a deflector element for deflecting a gas stream coming from the air delivery channel, said deflector element having one end extending transverse to the direction of the air flow from the air delivery channel and partially extending therein, said deflector element comprising cross-guide surfaces which extend parallel to the direction of the gas stream in the combustion chamber.

10. A gas burner according to claim 9, wherein the guide surfaces of the deflector element are arranged in the form of a cross and are angled-off at an end pointing toward the combustion chamber with the angled-off sections pointing in the same direction with reference to a rotation around the longitudinal axis of the deflector element to cause rotational turbulence.

* * * * *